United States Patent [19]

Lowe et al.

[11] 4,198,844

[45] Apr. 22, 1980

[54] TUBE EXPANDER

[75] Inventors: Jerome R. Lowe, Seymour; Frank P. Russo, Waterbury, both of Conn.

[73] Assignee: J & S Hydraulics Inc., Milford, Conn.

[21] Appl. No.: 1,200

[22] Filed: Jan. 5, 1979

[51] Int. Cl.[2] ..... B21D 41/02

[52] U.S. Cl. ..... 72/393; 92/13.8

[58] Field of Search ..... 92/13.8; 72/125, 392, 72/393

[56] References Cited

U.S. PATENT DOCUMENTS

| | | | |
|---|---|---|---|
| 183,241 | 10/1876 | Work | 72/393 |
| 1,610,796 | 12/1926 | King | 72/393 |
| 2,654,413 | 10/1953 | Weidel | 72/393 |
| 3,385,087 | 5/1968 | Huth | 72/393 |

FOREIGN PATENT DOCUMENTS

| | | | |
|---|---|---|---|
| 28641 | of 1903 | United Kingdom | 72/393 |

*Primary Examiner*—Lowell A. Larson

*Attorney, Agent, or Firm*—John A. Mitchell; Pasquale A. Razzano

[57] ABSTRACT

A tube expander for expanding or flaring the ends of automobile exhaust pipes and the like includes a segmented expander die having an arbor slidably received within the expander die segments for expanding the die upon movement of the arbor in a first predetermined direction. A manually operated device initially moves the arbor in the first direction to expand the die until the die segments engage the interior surface of the tube end to be expanded, and a separate independent hydraulic mechanism is then operated to move the arbor in the first direction in order to flare the tube to increase its diameter by a predetermined dimension. The compact structure provided enables the tool to be manually operated to flare tubes in situ on an automobile.

19 Claims, 5 Drawing Figures

TUBE EXPANDER

The present invention relates to tube expanders, and more particularly to a hand held tube expander adapted to be used to flare the ends of automobile exhaust pipes or tubes, mufflers and other articles in situ.

In the installation of exhaust systems for automobiles it is often necessary for connecting ends of exhaust pipes, or even the end tubes of mufflers, resonators and other exhaust system elements, to be flared in order to form a mating coupling with an adjacent segment of pipe or tube. (In this application the terms "pipe" and "tube" are used interchangeably). Heretofore the pipes or tubes have been bent and the ends flared on relatively large expensive machine stands such as are available from the Huth Division of Midas-International Corporation. Such stands necessitate the complete removal of a pipe or tube from the automobile in order to flare the pipe or tube ends. For example, when a muffler alone is replaced, it may be necessary to flare the adjacent ends of the exhaust pipe to which it is to be connected. Heretofore it was not possible to flare the end of the pipe or tube in situ; rather, the pipe or tube had to be removed from the automobile and expanded on the swaging and expanding stands of the prior art. This of course represents an unnecessary expense in labor and time to remove the pipe or tube, and it would be far preferable to be able to expand the pipe or exhaust tube in situ on the automobile.

It is an object of the present invention to provide a hand held tube expander adapted particularly for use in expanding the ends of exhaust tubes in automotive exhaust systems.

Another object of the present invention is to provide a tube expander arrangement which is relatively simple in operation and durable in use.

A still further object of the present invention is to provide a tube expander arrangement which can expand pipes or tubes of a variety of different diameters by a predetermined extent, with a simple manual adjustment.

A further object of the present invention is to provide a hand held tube expander or swaging device which is manually adjustable and relatively simple to operate.

In accordance with an aspect of the present invention a hand held tube expander is provided in which a generally cylindrical hollow expansion die is used that consists of a plurality of die segments and an arbor received in the die. The die and arbor have cooperating inclined surfaces arranged to expand the die segments when the arbor is moved in a first predetermined direction. In operation of the device the arbor is initially moved manually to engage the segments of the die with the interior surface of the tube to be expanded. When this occurs further manual adjustment is not conveniently possible, and a second arrangement is provided for further movement of the arbor in order to flare the pipe. This arrangement consists of a hydraulically operable mechanism for drawing the arbor from its first manually expanded position to at least a predetermined position in order to flare the tube and increase its diameter by a predetermined dimension.

The above, and other objects, features and advantages of this invention, will be apparent in the following detailed description of an illustrative embodiment thereof, which is to be read in connection with the accompanying drawing, wherein.

Figures 1, 2, 3:
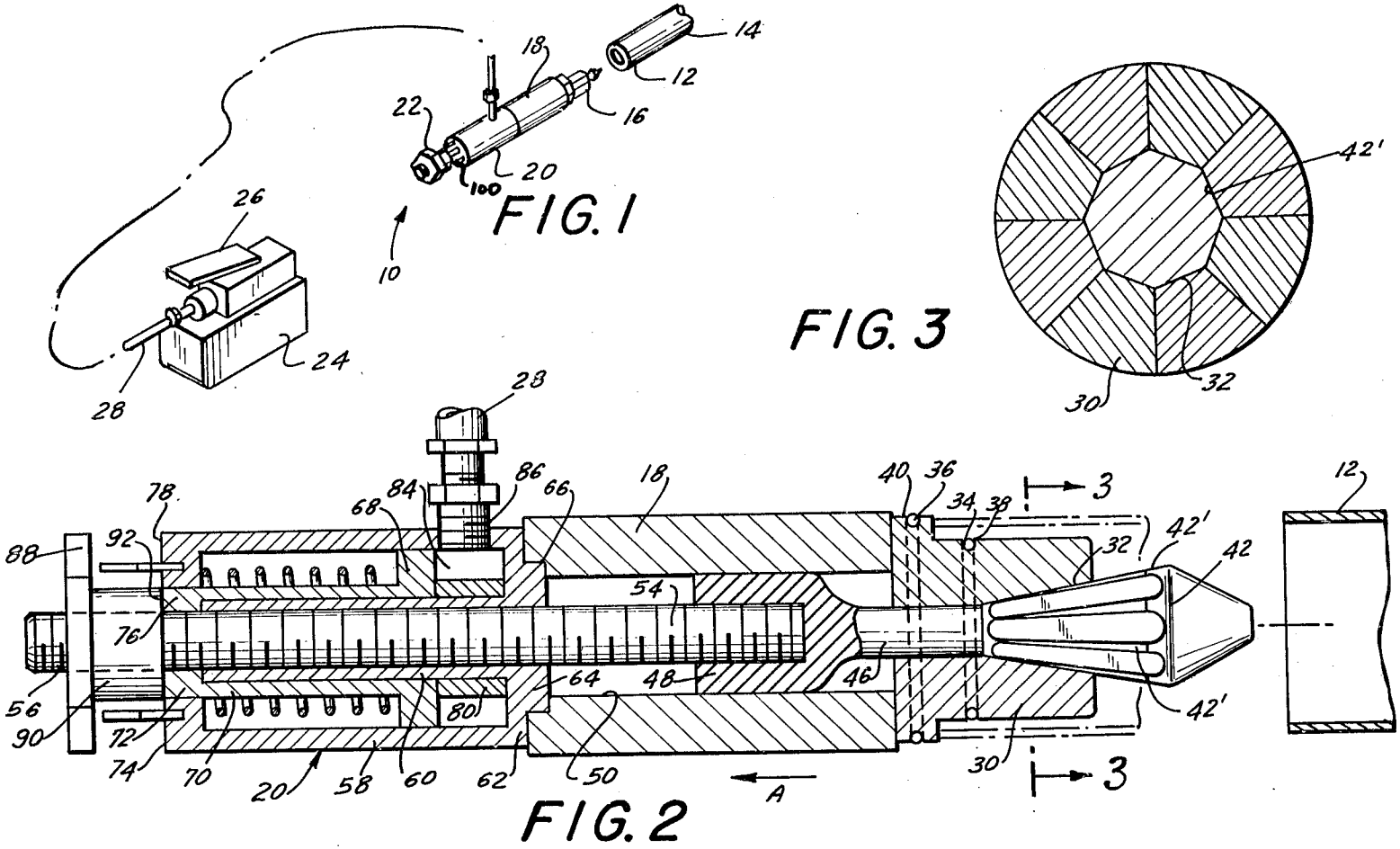
FIG. 1 is a perspective view of a tube expander constructed in accordance with the present invention.
FIG. 2 is a longitudinal sectional view of the expander shown in FIG. 1, and showing, in dotted lines, a tube end placed over the expander die.
FIG. 3 is a sectional view taken along line 3—3 of FIG. 2.

Referring now to the drawing in detail, and initially to FIG. 1 thereof, an expander device 10 constructed in accordance with one embodiment of the present invention is shown which is adapted to flare the end 12 of a metal tube 14, such as used in an automotive exhaust system. The expander includes a die 16, collar 18 and hydraulic ram 20 that serves to operate die 16 during expansion or swaging of tube end 12. A manual adjustment 22 is provided, as described hereinafter, which permits adjustment of die 16 to accommodate tube ends of different diameters.

Expander 10 is controlled by an air-oil pump 24 which is of conventional construction and available as pump number PA 133 from the Enerpac Division of Applied Power Corporation. This pump is connected to a source of shop air (not shown) and when valve 26 is operated oil under pressure is supplied through a flexible tube 28 to ram 20 in order to operate expander die 16, under the influence of high pressure, as described hereinafter.

The die 16 of expander 10 (see FIGS. 2 and 3) consists of a plurality of wedge segments 30 that define a die having a cylindrical outer surface and an octagonally shaped central opening 32. The die segments are retained in their cylindrical configuration by a pair of endless coil springs 34, 36 which are received in grooves 38, 40, on the outer surfaces of the segments. An arbor element 42 is received within the octagonal central opening 32 of die 16 formed by segments 30. Arbor 42 has a generally conical configuration with eight relatively flat surfaces formed thereon between eight beveled edges 42'. The flat surfaces of the arbor mate with the flat inner surface portions of the segment 30. Upon movement of arbor 42 in the direction of the arrow A in FIG. 2, the wedge segments will be expanded against the springs 34, 36 by the engagement of their inner surfaces against flat surfaces of the arbor, as seen in FIG. 3.

As thus far described, the expansion die used in the apparatus of the present invention is conventional and is similar to the expansion dies used on the Huth equipment previously discussed above. In the conventional operation of prior art expanders, the end 12 of tube 14 is simply placed over the die (which is selected to closely match the inner diameter of the tube) and the die is expanded in order to flare the end of the tube. However, with the present invention, the die is initially expanded manually through a first step in order to adjust the die to the size of the tube being expanded, and then in a second step pressurized hydraulic fluid is supplied to ram 20 in order to flare the tube under pressure. This enables the manually held tube expander of the invention to be used with tubes or pipes of a variety of different sizes by means of a simple manual adjustment.

Referring again to FIG. 2, arbor 42 includes a stem portion 46 and a socket portion 48. Socket 48 is received in the bore 50 of the cylindrical aluminum collar 18 which cooperates with socket 48 to guide movement of the arbor in a relatively straight path of travel so that there is little or no wear on the socket and bore or on the cooperating surfaces of the arbor and wedge segments.

Socket 48 is threadably engaged with a threaded rod 54, that extends through hydraulic ram 20, to a free end 56. Ram 20 is also of conventional construction and is a commercially available power element. It includes a casing 58 having an integral internal sleeve 60 formed therein. The sleeve receives threaded rod 54 which can slidably pass through the sleeve and thus the ram, as described hereinafter. Preferably the inner end 62 of the ram 20 has an extended portion 64 which is received in a recess or well 66 in collar 18 in order to form a rigid and aligned coupling between the collar and ram. This coupling may be threaded, although that is not necessary. A mere frictional engagement is sufficient.

A hollow piston 68 is provided within casing 58 of ram 20 and includes a hollow generally cylindrical piston rod 70 that surrounds the inner sleeve 60 of casing 58 and is slidable with respect thereto. Preferably, the piston and its integral hollow piston rod 70 are plated with bronze, while casing 58 is formed of steel. The piston rod extends through an opening 72 in the end 74 of the casing and in the at rest position the extreme end 76 of the piston rod is generally aligned with end 78 of the casing. This position of the piston rod is defined by a central stop collar 80 located on sleeve 60. The piston 68 is biased into this position by a coiled spring 82 contained within the casing between the end 78 thereof and the piston. The piston defines a fluid supply chamber 84 in the casing 58 at the right end thereof to which the hose 28 is connected through a port 86, in any convenient manner.

A nut 88 is threadably engaged on the free end 56 of rod 54 and has a cylindrical extension or collar 90 formed integrally therewith. The nut is turned down on rod 54 so that the end 92 of the sleeve 90 engages the end face 76 of the piston rod. When this is done, the hydraulic ram 20 is held in tight mating engagement in collar 18, between nut 88 and swaging die 16. In this configuration the tube expander is now ready for use.

Figure 4:
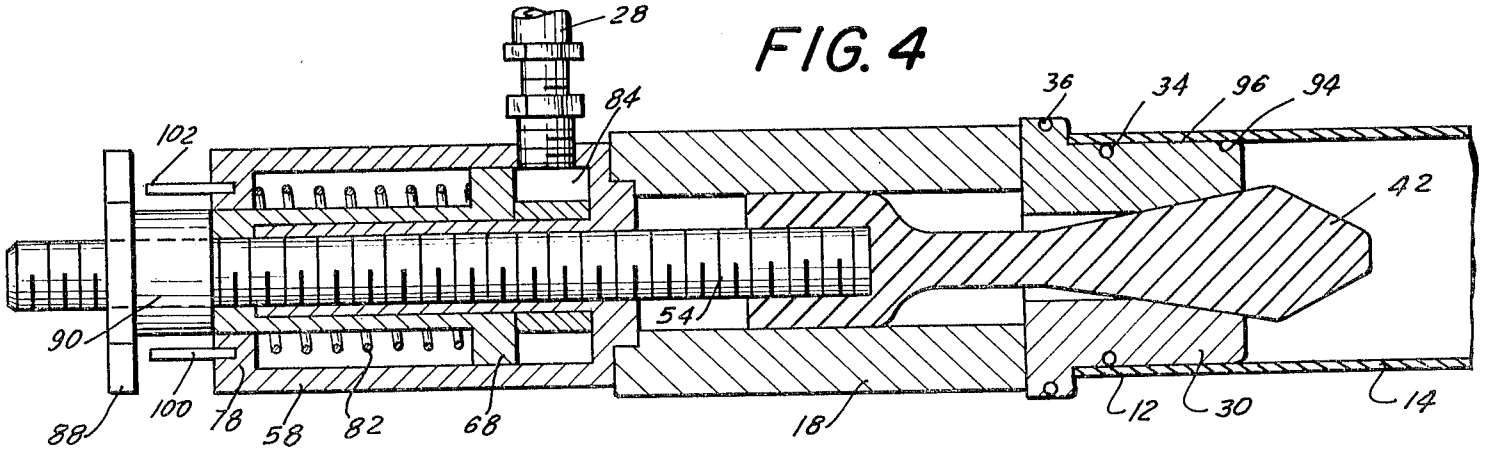
FIG. 4 is a sectional view similar to FIG. 2 showing the configuration of the elements of the expander upon completion of the manual adjustment of the expander die.
Figure 5:
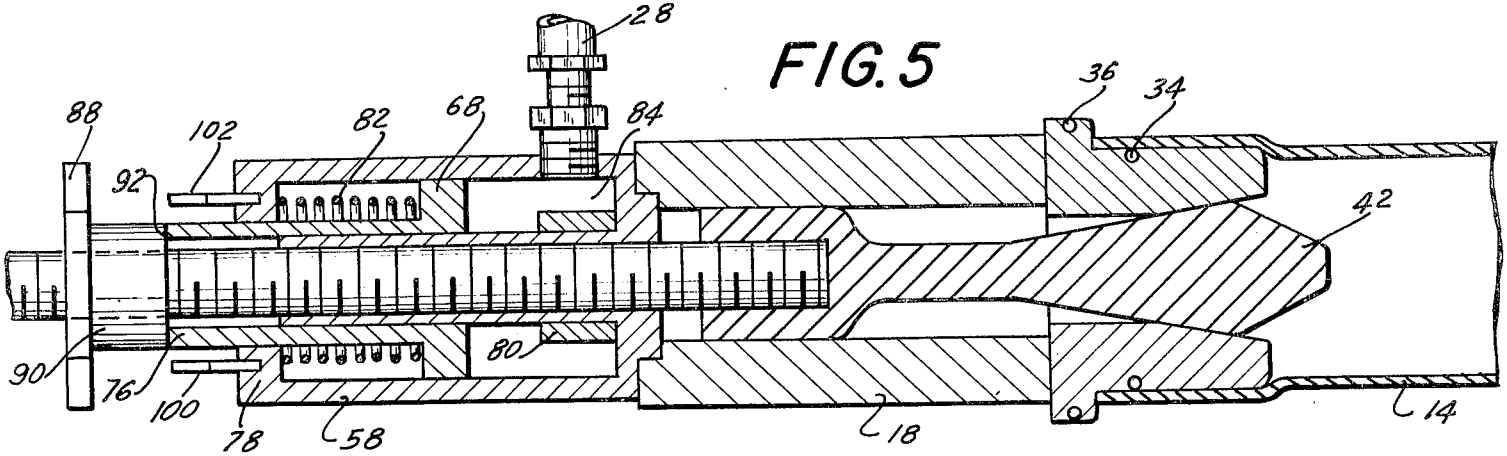
FIG. 5 is a longitudinal sectional view similar to FIGS. 2 and 4 showing the configuration of the apparatus upon the completion of the application of hydraulic pressure to the expander to expand the tube end.

The first step in use of the apparatus is to insert the swaging die 16 into the end 12 of tube 14. Then, nut 88 is turned on the rod 54 in a clockwise direction. This draws rod 54 towards the left, in the direction of arrow A, pulling arbor 42 with it. Movement of the arbor in this direction causes the cooperating surfaces on the arbor and die segment to engage and push the die segments radially outwardly against the bias of their associated springs 34, 36 until the outer surfaces 94 of the die segments engage the inner surface 96 of tube 14. When this occurs, further manual rotation of the nut will be resisted. This position of the apparatus is shown in FIG. 4. At this point, the flaring operation can be performed and the operator then simply actuates valve 26, either by hand or with his foot, in the known manner, so that hydraulic fluid under pressure is supplied through tube 28 to chamber 84, urging piston 68 to the left in FIG. 5. This movement of the piston pushes nut 88 further to the left and thus pulls rod 54 in the same direction, drawing arbor 42 with it. Movement of the arbor further expands the die segments, flaring the end of the tube. When the tube has been flared the desired amount, application of pressure to the ram is relieved by releasing valve 26, and the flaring operation is completed. Release of the hydraulic pressure permits piston 68 to return to the right under the bias of spring 82, pushing rod 54 and arbor 42 towards the right, causing the expanded die to collapse under the influence of the springs 34, 36. This permits the die to be removed from the tube end.

In accordance with the present invention a conveniently used guide arrangement provides an indication when the tube end has been flared the desired amount, e.g. an increase in diameter of one quarter of an inch. To this end a pair of indicating pins 100 are provided on the end 78 of ram casing 58. The pins extend from the casing end a distance of one half of an inch since, in accordance with the preferred embodiment of the invention, one half inch of travel of the arbor corresponds to one quarter inch radial expansion of the die. With this arrangement, when the interface between the end 92 of nut sleeve 90 and end 76 of the piston rod are aligned with the free ends 102 of pins 100, as seen in FIG. 4, the operator knows that the tube end has been flared one quarter of an inch and he can then release the pressure applied to the ram. The ram will then retract, as described above.

By the construction of the present invention a lightweight tube expander tool is provided which is relatively easy to assemble and disassemble. Its light weight makes the tool convenient for manual use in situ expansion operations. As the arbor travels only about one half of an inch under pressure to complete the flaring operation there is little or no wear. The adjustment of the arbor to fit each individual tube size is manual and under little or no pressure so that essentially no wear occurs in that portion of the operation.

Although a specific type of hydraulic ram has been described herein with reference to the presently preferred embodiment of the invention, it is contemplated that other types of power supplies can be connected to shaft 54 in order to move the arbor during the power portion of the flaring operation. For example, a double acting ram could be utilized, or air rams rather than hydraulic rams could also be used.

Although an illustrative embodiment of the present invention has been described herein with reference to the accompanying drawings it is to be understood that various other changes and modifications may be effected therein by one skilled in the art without departing from the scope or spirit of this invention.

What is claimed is:

1. A tube expander comprising a segmented expander, an arbor slidably received in said expander for expanding the expander upon movement of the arbor in a first predetermined direction, first means for moving said arbor in said first direction to expand the expander a first predetermined amount and second means, independent of said first means, for moving said arbor in said first direction a second predetermined amount to flare a tube end inserted on said segmented expander.

2. A tube expander as defined in claim 1 wherein said first means comprises a threaded rod secured at one end to said arbor and a nut on the other end of said rod located to draw the rod through the nut upon rotation of the nut thereby to draw the arbor through said segmented expander.

3. A tube expander as defined in claim 2 wherein said second means is a hydraulic ram.

4. A tube expander as defined in claim 3 wherein said hydraulic ram includes a casing and a hollow piston rod including an integral piston in said casing, said piston rod extending through said casing and said threaded rod extending through said casing and piston rod, said nut being engaged with said piston rod, and means for supplying fluid under pressure to said casing at least on the side of the piston away from said nut.

5. A tube expander as defined in claim 4 including spring means in said casing engaged between the casing and the piston on the side of the piston facing the nut.

6. A tube expander as defined in either of claims 2 or 5 wherein said second means includes indicia means providing a visual indication when the arbor has been moved in said first direction by said second means a distance sufficient to flare the tube end said predetermined amount.

7. A tube expander as defined in claim 6 wherein said indicia means comprises at least one pin extending from said second means parallel to said threaded rod and aligned with said nut.

8. A tube expander as defined in claim 7 including a hollow collar positioned between said expander and said second means and receiving at least a portion of said arbor.

9. A tube expander as defined in claim 8 wherein said arbor includes a guide section received in the hollow collar and cooperating therewith to guide the movement of the arbor.

10. A tube expander comprising a generally cylindrical hollow expansion die including a plurality of die segments, an arbor received in said die, said die and arbor having cooperating inclined surfaces arranged to expand the die segments when the arbor is moved in a first predetermined direction, manually operable means operatively engaged with said arbor for drawing the arbor in said first direction until the arbor segments are expanded to a first position in engagement with the interior surface of a tube placed on the expansion die for flaring, and hydraulically operable means for drawing the arbor from said first position through at least a predetermined distance to flare said tube and increase its diameter by a predetermined dimension.

11. A tube expander as defined in claim 10 wherein said hydraulically operable means comprises a hydraulic ram including a casing and a piston therein operatively engaged with said arbor.

12. A tube expander as defined in claim 11 wherein said piston includes an elongated hollow tube extending through said casing on the side thereof opposite said arbor; said manually operable means including a threaded rod fixed to said arbor and extending through said elongated hollow tube to a free end and a nut threadably engaged with said rod and normally turned down thereon into engagement with said end of the piston's elongated hollow tube whereby rotation of the nut in a predetermined direction causes said threaded rod and arbor to move in said first direction.

13. A tube expander as defined in claim 12 including means for supplying fluid under pressure to said casing at least on the side of the piston away from said nut whereby when pressurized fluid is supplied to said side of the piston the piston is urged in said first direction against said nut thereby drawing said rod and arbor in said first direction to flare a tube end placed on said die.

14. A tube expander as defined in claim 13 including spring means in said casing engaged between the casing and the piston on the side of the piston facing the nut.

15. A tube expander as defined in any of claims 10 to 13 including indicia means providing a visual indication when the arbor has been moved in said first direction by said hydraulic means a distance sufficient to flare a tube on the die to said predetermined dimension.

16. A tube expander as defined in claim 14 including indicia means providing a visual indication when the arbor has been moved in said first direction by said hydraulic means a distance sufficient to flare a tube on the die to said predetermined dimension.

17. A tube expander as defined in claim 16 wherein said indicia means comprises at least one pin mounted on said casing parallel to said threaded rod and the hollow tube of the piston, said pin being dimensioned to extend from said casing a predetermined distance selected to indicate that the tube on the die has been flared to said predetermined dimension when the engaging faces of the nut and hollow tube of the piston are aligned therewith.

18. A tube expander as defined in any of claims 10 to 14, 16 or 17 including a hollow collar positioned between said expansion die and said hydraulic means.

19. A tube expander as defined in claim 18 wherein said arbor includes a guide section received in the hollow collar and cooperating therewith to guide the movement of the arbor.

* * * * *